US008621887B1

(12) United States Patent
Arlow

(10) Patent No.: US 8,621,887 B1
(45) Date of Patent: Jan. 7, 2014

(54) INTERCHANGEABLE EARRING FOR INDIVIDUALS WITH PIERCED SENSITIVE EARS

(71) Applicant: Jessica S. Arlow, West Seneca, NY (US)

(72) Inventor: Jessica S. Arlow, West Seneca, NY (US)

( * ) Notice: Subject to any disclaimer, the term of this patent is extended or adjusted under 35 U.S.C. 154(b) by 16 days.

(21) Appl. No.: 13/792,837

(22) Filed: Mar. 11, 2013

Related U.S. Application Data

(60) Provisional application No. 61/849,295, filed on Jan. 24, 2013.

(51) Int. Cl.
*A44C 17/02* (2006.01)

(52) U.S. Cl.
USPC ..... 63/29.2; 63/12; 63/900

(58) Field of Classification Search
USPC ..... 63/29.2, 900, 12, 13
See application file for complete search history.

(56) References Cited

U.S. PATENT DOCUMENTS

| | | | | |
|---|---|---|---|---|
| 3,034,320 | A * | 5/1962 | Feibelman | 63/14.1 |
| 3,509,734 | A * | 5/1970 | Lederer | 63/15 |
| 3,890,800 | A * | 6/1975 | Montague | 63/13 |
| 4,195,492 | A * | 4/1980 | Johnson | 63/12 |
| 4,682,477 | A * | 7/1987 | Vaillancourt | 63/12 |
| 5,806,346 | A * | 9/1998 | Schlinger et al. | 63/40 |
| 6,305,192 | B1 * | 10/2001 | Indiveri et al. | 63/12 |
| 7,802,448 | B2 * | 9/2010 | Chan | 63/3.1 |
| 8,474,108 | B2 * | 7/2013 | Eisenberger | 24/303 |
| 2009/0282868 | A1 * | 11/2009 | Dobashi | 63/29.2 |
| 2012/0240623 | A1 * | 9/2012 | Morse | 63/13 |

* cited by examiner

*Primary Examiner* — Emily Morgan
(74) *Attorney, Agent, or Firm* — Anna Vishev, Esq.

(57) ABSTRACT

An earring having a rod member passable through an ear-pierced hole of a wearer, a housing connected to the rod member, and a magnetic member positioned within the housing. The rod member is made of a high-quality non-allergenic material, and a low cost ornament can be attached thereto by the magnetic member.

7 Claims, 6 Drawing Sheets

INTERCHANGEABLE EARRING FOR INDIVIDUALS WITH PIERCED SENSITIVE EARS

RELATED APPLICATIONS

This application claims all rights of priority to U.S. Provisional Patent Application No. 61/849,295 filed on Jan. 24, 2013 (pending), which is fully incorporated herein by reference.

FIELD OF THE INVENTION

The presently disclosed principles and inventions are related to interchangeable earrings for individuals with pierced sensitive or allergic ears.

BACKGROUND OF THE INVENTION

Earrings are typically sold to consumers as finished products. Individuals with sensitive ears have restricted choices when shopping for earrings as many individuals with sensitive pierced ears can only wear products made of platinum or 14 kt gold up to 24 kt gold metals. There have been several attempts to modify earrings and create interchangeable jewelry. Erickson (U.S. Pat. No. 4,781,036) describes an earring in which an ornament can screw on and off from the base post. Green (U.S. Pat. No. 5,927,104) describes an earring in which the front ornament can screw on and off, being replaced with various front ornaments. Monahan (U.S. Pat. No. US 2009/0282867 A1) describes a kit consisting of interchangeable ornaments which can be placed individually or in combination to create an earring or necklace, organized in a designated box. Lichtenstien (U.S. Pat. No. 5,836,176) describes an interchangeable earring consisting of a looped pin secured to the earlobe and a kit containing pieces to assemble an ornament designed to attach to the looped pin. These inventions are different mechanically as they do not use a magnetic clasp to secure the ornament to the post or wire. They also are not said to be exclusively made of platinum, titanium or 14 kt gold through 24 kt gold metals, which would make them unacceptable for individuals to wear in sensitive pierced ears. These inventions are different in purpose, as the earrings described are not for specific use for individuals with allergic or sensitive earlobes, and are also different in mechanical function.

SUMMARY OF THE INVENTION

In one general aspect, the invention provides an earring having a rod member passable through an ear-pierced hole of a wearer, a housing connected to the rod member, and a magnetic member positioned within the housing In one specific aspect, the rod member is made of a high-quality non-allergenic material, and a low cost ornament can be attached thereto by the magnetic member.

In another specific aspect, the earring further includes an ornamental attachment piece having an attachment member configured to removably attach to the magnetic member so as to removably and interchangeably secure the ornamental attachment piece to the housing.

BRIEF DESCRIPTION OF DRAWINGS

The invention is illustrated in the figures of the accompanying drawings which are meant to be exemplary and not limiting, in which like references are intended to refer to like or corresponding parts, and in which.

DETAILED DESCRIPTION OF THE EMBODIMENTS

In the following description, reference is made to the accompanying drawings that form a part hereof, and in which is shown by way of illustration specific embodiments in which the invention may be practiced. It is to be understood that other embodiments may be utilized and structural changes may be made without departing from the scope of the present invention.

Figure 1:
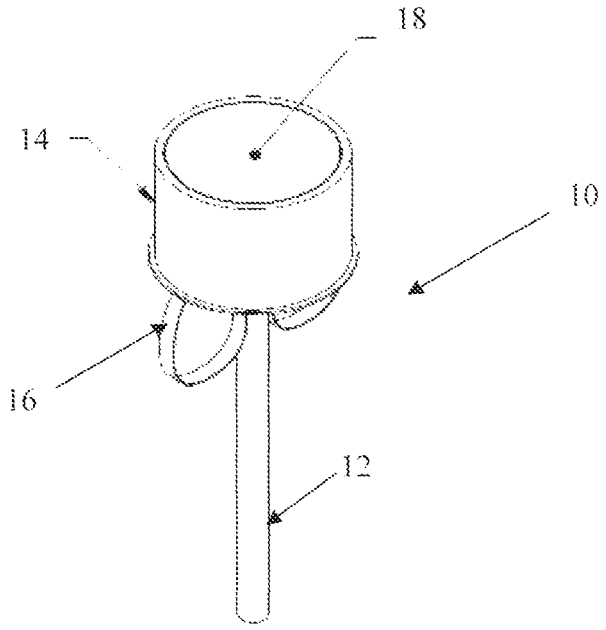
FIG. 1 is a side perspective view of a post-style earring without an ornamental attachment in accordance with the first embodiment of the invention.
Figure 2:
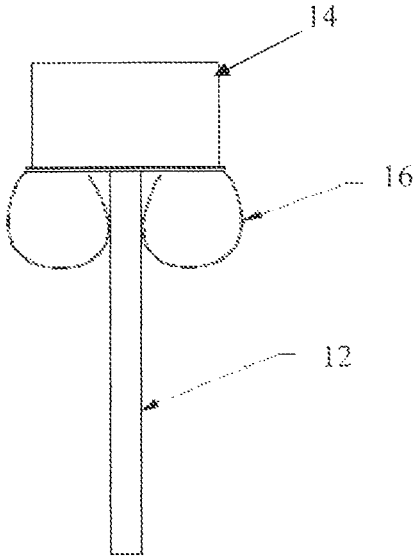
FIG. 2 is a side view of a post-style earring without an ornamental attachment in accordance with the first embodiment of the invention.

Referring now to the drawings, in which like numerals represent the same or similar elements, and, initially, to FIGS. 1 and 2, in which an exemplary post-style earring 10 is illustrated. As shown in the figures, post-style earring 10 preferably includes a post-style earring rod 12 securely attached to the housing 14, an earring backing 16 slidably movable along the earring rod 12, and a magnet 18 inserted into and fixedly secured within housing 14. In use, the earring backing 16 is removed from the earring rod 12 to enable the wearer to insert the earring rod into a pierced ear hole. The backing is then placed back onto the earring rod and is slidably moved along the rod so as to secure a wearer's earlobe between the backing 16 and the housing 14.

In the preferred embodiment, the earring rod 12 is made of a non-allergenic material, for example, platinum or 14-24 Kt gold, so as to prevent skin sensitivity of a wearer. The housing preferably has a cylindrical shape with a hollow interior and is made of a non-ferrous material. Magnet 18 is preferably disc-shaped and is secured within the housing with an adhesive. The magnet is preferably 3 mm-10 mm in diameter. It should be understood by a person skilled in the art that in a simplified embodiment, magnet 18 may be directly secured to the earring rod 12 without the use of housing 14. Similarly, it should be understood that, although the magnet and the housing are described as being circular and cylindrical in shape, respectively, any other shape can be utilized.

Figure 3:
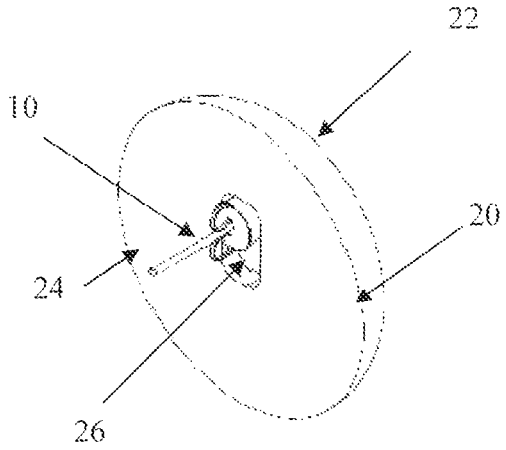
FIG. 3 is a side perspective view of a post-style earring with an ornamental attachment in accordance with the first embodiment of the invention.
Figure 4:
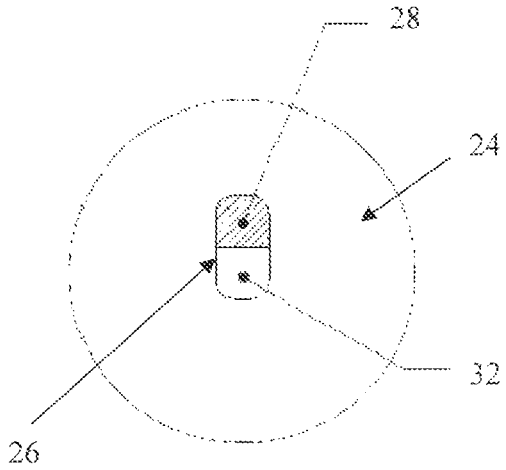
FIG. 4 is a back view of the ornamental attachment in accordance with the first embodiment of the invention.
Figure 5:
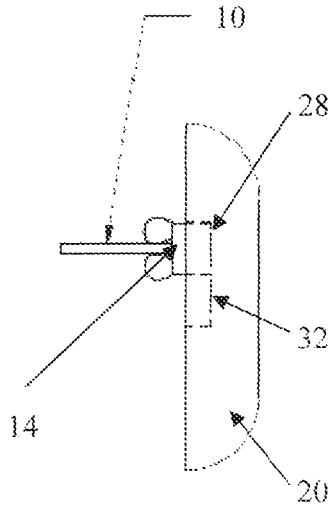
FIG. 5 is a side view of a post-style earring with an ornamental attachment in accordance with the first embodiment of the invention.

As shown in FIG. 3, an interchangeable ornamental knob attachment 20 removably attachable to the post-style earring 10 is provided in accordance with the preferred embodiment of the invention. Ornamental knob attachment 20 preferably includes a front decorative side 22, a rear panel 24 and an aperture 26 formed at the rear panel. Aperture 26 is shaped as an elongated tunnel having a length and a width, the width of the tunnel being is sized to snugly fit the housing 14 therein and the length of the tunnel being longer than a diameter of the housing. The tunnel preferably includes a ferrous metal portion 28 and a non-ferrous portion 32. As shown in FIG. 5, when housing 14 of the post-style earring 10 is inserted into the aperture 26, it is positioned such that magnet 18 is located adjacent to the ferrous metal portion 28, thereby magnetically attracting each other and removably attaching post-style earring 10 to the ornamental attachment 20. Any suitable material can be used to manufacture the ornamental attachment. Because there is a space between the ornamental attachment and a wearer's skin, the material of the attachment is not placed into direct contact with the wearer's skin, and no allergic reaction occurs.

Although in the above-described embodiment the ornamental attachment 20 is secured to the post-style earring 10 by means of the aperture 26 and the inserted therein housing 14 with magnet 18, it should be understood by a person skilled in the art that the removable attachment can be also be accomplished by simply forming at least a portion of the rear panel 24 of a ferrous metal and attaching magnet 18 to this portion of the rear panel.

In use, a wearer would remove the earring backing from the earring rod 12, insert the rod into an earring hole, and secure the earring 10 with the backing 16. The wearer would then secure the ornamental attachment 20 to the earring 10, thus creating a complete earring look. If the wearer decides to change the look, he/she can simply exchange one ornamental attachment 20 for another without changing the earring 10 and without risking an allergic reaction.

Figure 6:
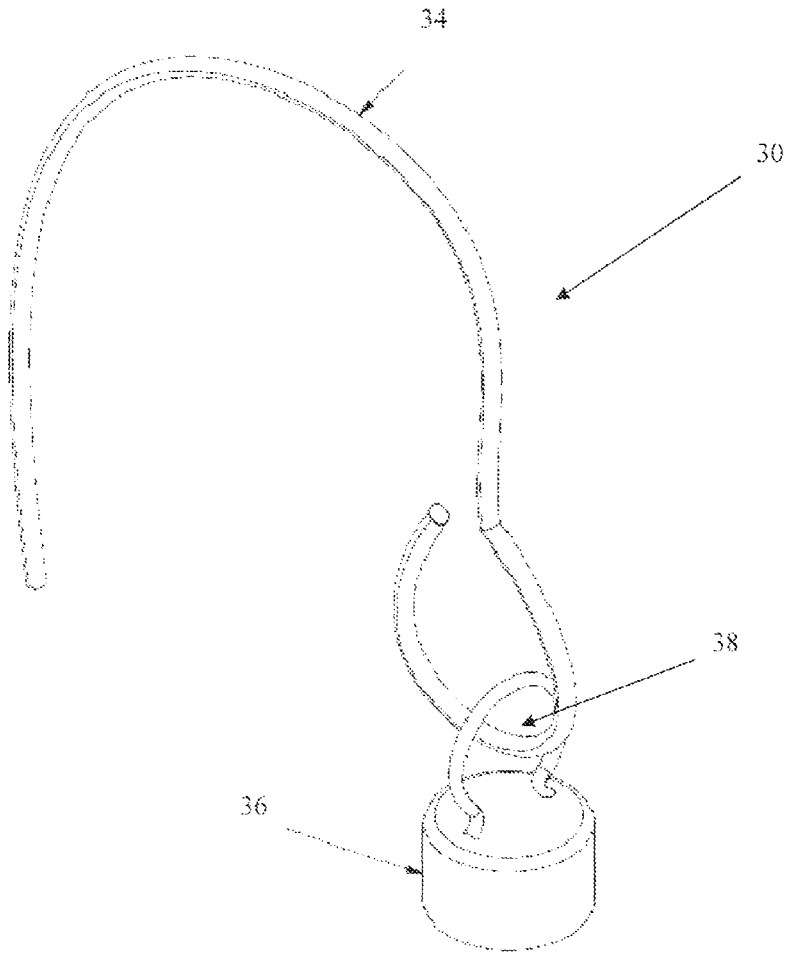
FIG. 6 is a side perspective view of a hook-style earring without an ornamental attachment in accordance with the second embodiment of the invention.
Figure 7:
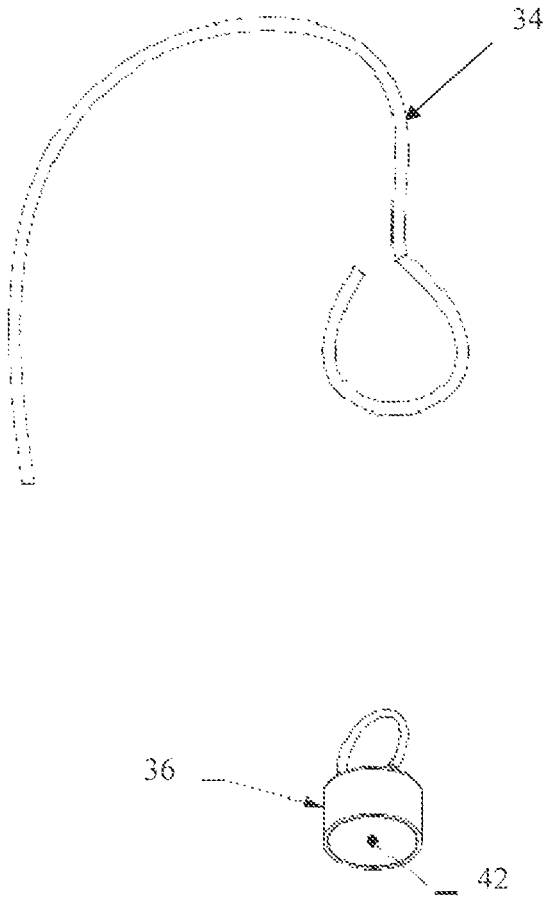
FIG. 7 is a detailed view of a hook-style earring without an ornamental attachment in accordance with the second embodiment of the invention.

The second preferred embodiment of the present invention is illustrated in FIGS. 6-9. As shown in FIGS. 6 and 7, an exemplary hook-style earring 30 is provided in accordance with this embodiment. Hook-style earring 30 preferably includes a hook-style earring rod 34 insertable into a wearer's ear hole. Hook-style earring rod 34 is preferably made of a non-allergenic material, for example, platinum or 14-24K gold, so as to prevent skin sensitivity or an allergic skin reaction of a wearer. A non-ferrous housing 36 is removably secured to the earring rod 34 by a hook and loop attachment mechanism 38. Any other suitable attachment mechanism may be utilized to secure housing 36 to the rod 34. Similarly to the first embodiment, housing 36 is preferably cylindrically-shaped with a hollow interior into which a disc-shaped magnet 42 is inserted. The magnet is preferably fixedly secured in the housing with an adhesive. Similarly to the above, the diameter of the magnet is preferably between 3 mm and 10 mm. Any other suitable shape of the magnet may be utilized.

Figure 8:
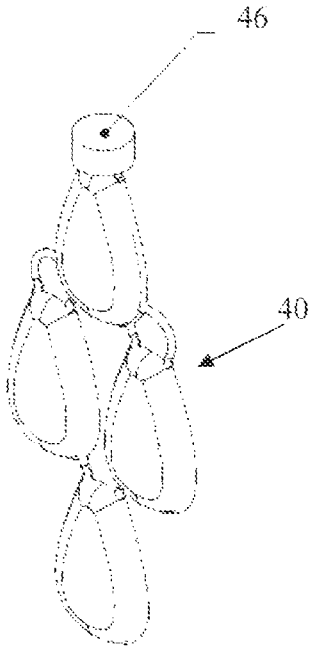
FIG. 8 is a side perspective view of the ornamental attachment for the hook-style earring in accordance with the second embodiment of the invention.
Figure 9:
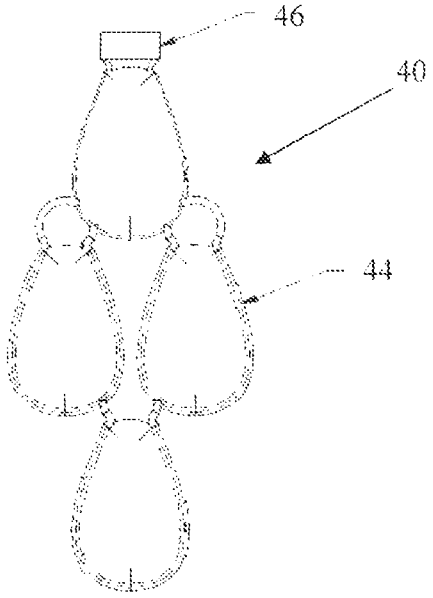
FIG. 9 is a front view of the ornamental attachment for the hook-style earring in accordance with the second embodiment of the invention.

As shown in FIGS. 8-9, an interchangeable ornamental pendant attachment 40 is provided in accordance with the second preferred embodiment of the invention. Ornamental pendant attachment 40 preferably includes a decorative member 44 and an attachment member 46. Attachment member 46 is preferably made from a ferrous metal material so as to form magnetic attraction with the magnet 42 of the hook-style earring 30, thereby, removably attaching the hook-style earring 30 to the ornamental pendant attachment 40. The size and shape of the attachment member 46 is preferably selected to roughly correspond to the size and shape of the magnet 42. Any suitable material can be used to manufacture the ornamental pendant attachment. In the preferred embodiment, the decorative member 44 is made of a non-ferrous metal material. Because, this material is not placed into direct contact with the wearer's skin, no allergic reaction occurs.

Alternatively, an entire ornamental pendant attachment 40 can be made from a ferrous metal material.

It should be noted that in both embodiments described above, a magnet provided on the earring portion adheres to a ferrous metal portion provided on the ornamental attachment. Although theoretically this can be reversed (or, alternatively, both sides can include magnets), it is not desirable to provide magnets on the ornamental attachment for two reasons: (1) this creates a greater possibility of assembly errors by providing pieces with incorrectly charged magnets, resulting in magnetic rejection, and (2) when ornamental attachments are stored together with other like attachments or other ferrous metal items, they would unintentionally adhere to one another, possibly damaging each other.

Finally, although the invention is described with respect to the two most popular earring styles, i.e., the post style and the hook style, other earring styles (e.g., lever back earrings, hoop earrings, snap-bar earrings, etc.) can be manufactured in the manner described in the present application.

The figures in this disclosure are conceptual illustrations allowing for an explanation of the present invention. Notably, the figures and examples above are not meant to limit the scope of the present invention to a single embodiment, as other embodiments are possible by way of interchange of some or all of the described or illustrated elements. Moreover, where certain elements of the present invention can be partially or fully implemented using known components, only those portions of such known components that are necessary for an understanding of the present invention are described, and detailed descriptions of other portions of such known components are omitted so as not to obscure the invention. In the present specification, an embodiment showing a singular component should not necessarily be limited to other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

The foregoing description of the specific embodiments so fully reveals the general nature of the invention that others can, by applying knowledge within the skill of the relevant art(s) (including the contents of the documents cited and incorporated by reference herein), readily modify and/or adapt for various applications such specific embodiments, without undue experimentation, without departing from the general concept of the present invention. Such adaptations and modifications are therefore intended to be within the meaning and range of equivalents of the disclosed embodiments, based on the teaching and guidance presented herein.

While various embodiments of the present invention have been described above, it should be understood that they have been presented by way of example, and not limitation. It would be apparent to one skilled in the relevant art(s) that various changes in form and detail could be made therein without departing from the spirit and scope of the invention. Thus, the present invention should not be limited by any of the above described exemplary embodiments, but should be defined only in accordance with the following claims and their equivalents.

What is claimed is:

1. An earring comprising:

a. a rod member configured to be passable through an ear-pierced hole of a wearer, the rod member comprising a first material;

b. a housing connected to the rod member, the housing comprising the first material;

c. a magnetic member positioned within the housing; and d. an interchangeable ornamental attachment piece comprising a second material and having a front surface and a rear panel, the rear panel having an aperture formed therein, the aperture having a length and a width, the width being sized to tightly fit the housing, and the length being longer than a diameter of the housing, and the aperture comprising a ferrous portion positioned at an end of the length, and a non-ferrous portion positioned at an opposite end of the length, the ferrous and non-ferrous portions are positioned to allow easier exchange of the ornamental attachment piece, wherein when the housing is positioned within the aperture, the magnetic member is removably attached to the ferrous portion of the aperture, wherein the first material is a non-allergenic material and wherein the second material is a material other than the non-allergenic material.

2. The earring according to claim 1, wherein the first material is a non-ferrous material.

3. The earring according to claim 1, wherein the housing is cylindrically shaped with a hollow interior and wherein the magnetic member is disc-shaped and is sized to fit tightly within the hollow interior of the housing.

4. The earring according to claim 3, wherein the magnetic member is fixedly secured to the housing with an adhesive.

5. The earring according to claim 3, wherein the magnetic member has a diameter of 3 mm to 10 mm.

6. The earring according to claim 1, wherein the ornamental attachment piece is a knob attachment.

7. The earring according to claim 1, wherein when the housing is removably attached to the ornamental attachment piece a space is formed between an ear of the wearer and the ornamental attachment piece.

* * * * *